US006105298A

United States Patent [19]

Grayson et al.

[11] Patent Number: 6,105,298

[45] Date of Patent: Aug. 22, 2000

[54] REMOVABLE WALLET INSERTS FOR STORING AND PROTECTING PHOTOGRAPHS

[76] Inventors: Barry H. Grayson, 333 E. 30 St. #17L; Martin C. Shanker, 300 E. 34 St. #28G, both of New York, N.Y. 10016

[21] Appl. No.: 09/243,766

[22] Filed: Feb. 3, 1999

[51] Int. Cl.[7] ..... A47G 1/06; A45C 11/18

[52] U.S. Cl. ..... 40/776; 40/765; 40/775; 40/654.01; 40/649; 150/147; 150/148

[58] Field of Search ..... 40/765, 776, 775, 40/124.2, 537, 654.01, 649, 774; 150/147, 148

[56] References Cited

U.S. PATENT DOCUMENTS

| | | | |
|---|---|---|---|
| 1,335,434 | 3/1920 | Garred | 40/775 X |
| 2,725,913 | 12/1955 | Horwin | 150/147 |
| 2,746,503 | 5/1956 | Knee | 150/147 |
| 3,660,915 | 5/1972 | Davis | 40/649 |
| 3,829,995 | 8/1974 | Fakoury | 150/147 X |
| 3,999,317 | 12/1976 | Owens | 150/147 X |
| 4,105,057 | 8/1978 | Baumann . | |
| 4,916,838 | 4/1990 | Holson | 40/776 |
| 4,942,913 | 7/1990 | Musso . | |
| 5,275,217 | 1/1994 | Eakin | 150/147 X |
| 5,431,207 | 7/1995 | Siegel | 150/147 X |
| 5,595,401 | 1/1997 | Exline . | |
| 5,713,406 | 2/1998 | Drury | 150/147 X |
| 5,775,398 | 7/1998 | Siegel | 150/147 X |
| 6,029,724 | 2/2000 | Rudnick | 150/147 X |

*Primary Examiner*—Terry Lee Melius
*Assistant Examiner*—Rodrigo J. Morales
*Attorney, Agent, or Firm*—Hopgood, Calimafde, Kalil & Judlowe

[57] ABSTRACT

A removable insert which is used to frame and protect personal photographs and the like for use in conventional wallets.

11 Claims, 5 Drawing Sheets

REMOVABLE WALLET INSERTS FOR STORING AND PROTECTING PHOTOGRAPHS

FIELD OF THE INVENTION

The present invention relates to wallets for holding cash, credit cards, personal photographs and the like. More particularly, the invention relates to inserts which are used to frame and protect items such as personal photographs in conventional wallets.

BACKGROUND OF THE INVENTION

Flexible storage receptacles for use with pre-existing wallets are described in U.S. Pat. No. 4,105,057 (hereinafter referred to as the "'057 patent") and also in U.S. Pat. No. 4,942,913 (hereinafter referred to as the "'913 patent"). These devices are destined for "after market" applications where a retailer who sells conventional wallets also offers special inserts for the wallets. The flexible receptacle shown in the '057 patent is designed for use with a wallet or billfold and provides extra storage space for carrying additional credit cards. The flexible receptacle may; also be used to provide a credit card holder for billfolds which are not so equipped. Although it would be possible to place photographs within these receptacles, in order to view the photo, the photo would have to be removed from the receptacle. Repeated insertions and removals will eventually damage the photo.

The '913 patent shows a "sub-wallet" for use with a main wallet. The sub-wallet carries important items which the wallet owner always needs, while the remainder of the wallet carries items which are not absolutely necessary. In a pinch, the owner can subsist on the sub-wallet alone, and does not require the contents of the main wallet. Although photos could be placed in the wallet or the sub-wallet, it would not be possible to view more than one of these photos unless one were to remove them from the wallet or sub-wallet, thereby causing the photos to become worn and mutilated over time.

Other types of wallets are described in U.S. Pat. Nos. 5,431,207 and 5,775,398. These feature intricate compartmental arrangements for accommodating devices such as calculators, along with holders for accommodating various sundries. Such wallets are very complex, with the unfortunate result that the owner has no choice but to carry around the elaborate features of the wallet, some of which are never used.

U.S. Pat. No 5,595,401 describes a book for holding credit cards. Similar to the receptacle of the '057 patent (above), the card book provides additional carrying capacity for a wallet, or, alternatively, may be used as a dedicated credit card holder for wallets which have no card holders. The credit card book is not intended for repeated insertion into, and removed from, the wallet. Rather, in use, the credit card is removed from the book, and the book remains in the wallet.

SUMMARY OF THE INVENTION

We have recognized that none of the prior art references teach a wallet insert for carrying photographs which is designed for repeated insertion into, and repeated removal from, a conventional wallet while protecting photographs from physical damage and permitting the photograph to be viewed.

Accordingly, the invention is directed to a removable photograph-encasing insert for wallets. The insert is configured so as to encase one or more photographs in an envelope-like structure having at least a transparent portion and a non-transparent portion. A portion of the non-transparent portion may be configured to form a picture frame-like border around the transparent portion. A portion of the non-transparent portion may be configured to form a picture frame-like border around the transparent portion. An edge or surface of the transparent portion and an edge or surface of the non-transparent portion form a slit for insertion of the photograph therein. The insert is adapted for insertion into and removal from the wallet while the photograph is encased by the insert.

In a preferred embodiment of the invention, the insert is substantially credit card sized for insertion into, and removal from existing wallets. The insert may be comprised of a back piece having at least one surface and one edge, a transparent portion having a plurality of edges, and a frame. All but at least one edge of the transparent portion is affixed between the back piece and the frame, such that at least a portion of the transparent portion is not visually obstructed by the frame, and at least one surface or edge of the back piece and at least one edge of the transparent portion forming a slit for the insertion of a photograph therein. The back piece and the frame can, but need not, be made from one or more materials selected from a group consisting of leather, plastics, fabric and canvas. The transparent portions can, but need not, be made of a clear polyvinyl polymeric material.

According to a further embodiment of the invention, within the envelope-like structure and/or behind the transparent portion a novel photograph holding mechanism can be placed. Each photograph holding mechanism is comprised of a flat surface having a first end and a second end, wherein the first end has a photograph-engaging clip and the second end is provided with a handle means for inserting and withdrawing the photograph holding mechanism into and out of the wallet insert. The back piece is affixed to all but one edge of the frame with a material illustratively selected from the group consisting of stitching, laminates and adhesives.

In an alternate embodiment of the invention, the removable photograph holding insert for wallets comprises a back piece, one transparent member and a frame having a central edge. The transparent member is held between the back piece and the frame when the back piece is affixed to the frame such that the transparent member is visible through the central edge.

BRIEF DESCRIPTION OF THE DRAWINGS

The above invention is more fully understood by referring to the associated figures of which.

DETAILED DESCRIPTION OF THE INVENTION

Figure 1:
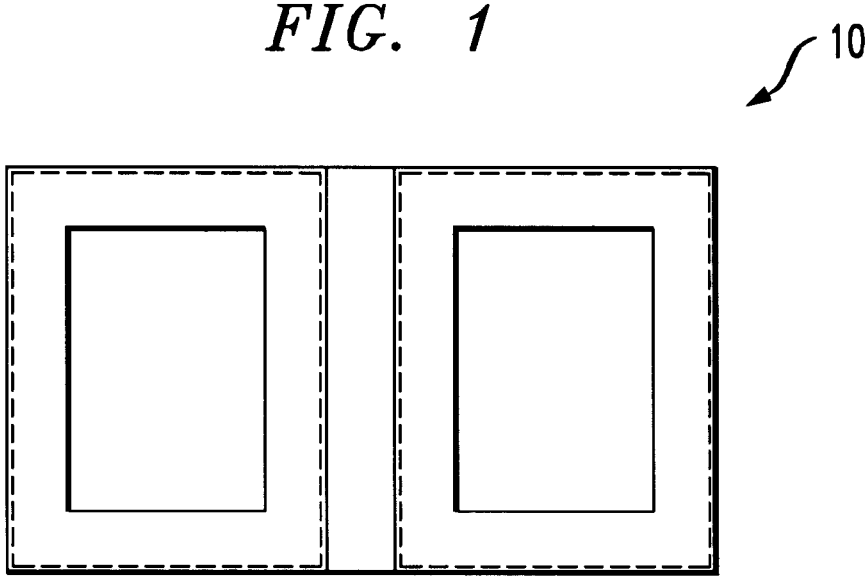
FIG. 1 shows a front elevational view of a preferred embodiment of the present invention in the opened state.
Figure 2:
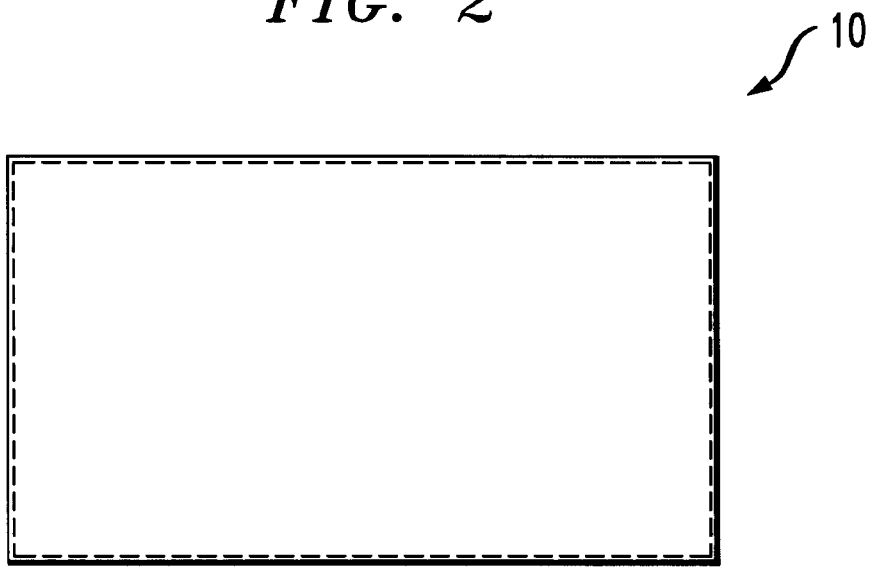
FIG. 2 depicts a rear elevational view of the embodiment shown in FIG. 1.

FIG. 1 depicts the front elevational view of the removable wallet insert 10 pursuant to a preferred embodiment of the present invention. This version is foldable, but in FIG. 1 it is shown in the "opened" state. Illustratively, the physical dimensions (width and height) of the insert in its open state are advantageously approximately the same as the corresponding dimensions (width and height) of the conventional credit card; for example, approximately 8.6 cm wide by 5.4 cm high. In this example, thickness of the insert can be less than, equal to, or greater than the thickness of a conventional credit card (about 0.7 mm.). FIG. 2 is the rear view of the embodiment shown in FIG. 1.

Figure 3:
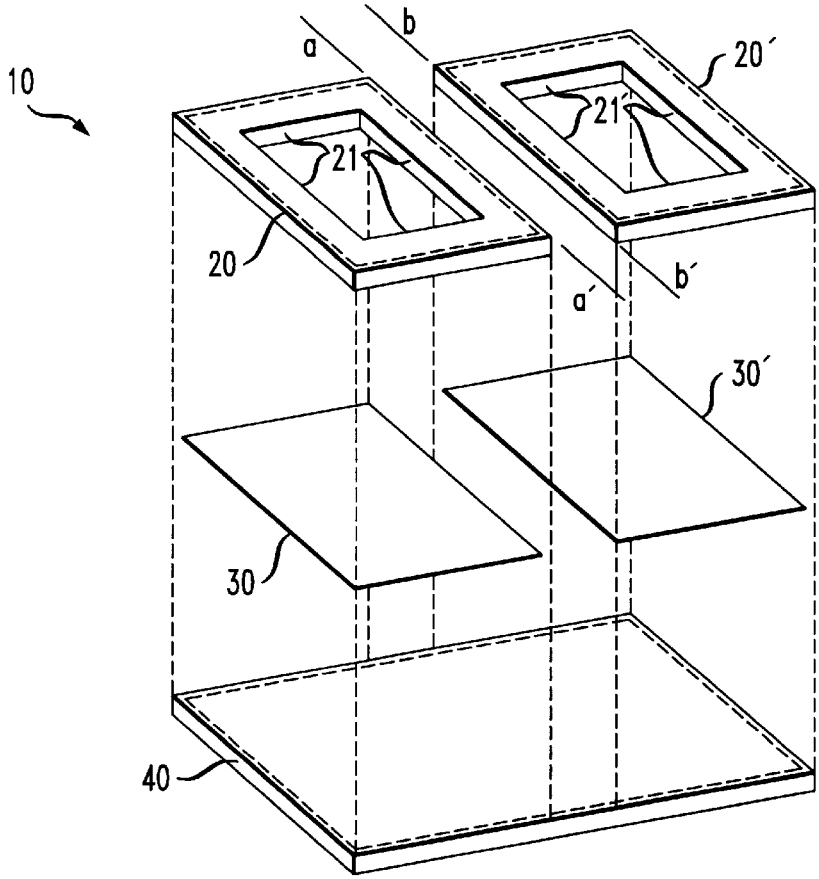
FIG. 3 shows an exploded view of the preferred embodiment shown in FIGS. 1 and 2, demonstrating its various constituent parts.

FIG. 3 shows an exploded view of the embodiment shown in FIGS. 1 and 2, listing the various constituent parts which are as follows:

The removable wallet insert 10 is comprised of a back piece 40, transparent portions 30 and 30', and non-transparent portions in the form of frames 20 and 20'. Back piece 40 and frames 20 and 20' can be made of leather, but one skilled in the art can substitute any material which is suitable for such pieces. For example, if the intended wallet for use in conjunction with the invention is made of vinyl or canvas, insert 10 can, but need not, be made of like materials. Frames 20 and 20' have respective edges 21 and 21', the perimeters of which form transparent apertures to enable the viewing of any photographs placed between transparent portions 30 and 30' and back piece 40. Across the length of edge a–a', transparent portion 30 is affixed to frame 20, but not to back piece 40, thereby forming a slit for insertion of a photograph therein. Across the remaining edges of the frame 20, the transparent portion 30 is affixed to the frame 20 and the back piece 40. Similarly, across the length of edge b–b', transparent portion 30 is affixed to frame 20 but not to back piece 40, thereby forming a slit for the insertion of a photograph therein. Across the remaining edges of the frame 20', the transparent portion 30' is affixed to the frame 20' and the back piece 40. Slits are shown at edges a–a' and b–b' for illustrative purposes, it being understood that these slits can alternatively be formed by another edge of the transparent portion, such as, for example, a bottom edge, a top edge or a side edge other than a–a' or b–b'. It is also possible to form a slit from an edge of the back plate and an edge or an surface of the transparent portion, if appropriate dimensions are selected for these structural elements.

Figure 4:
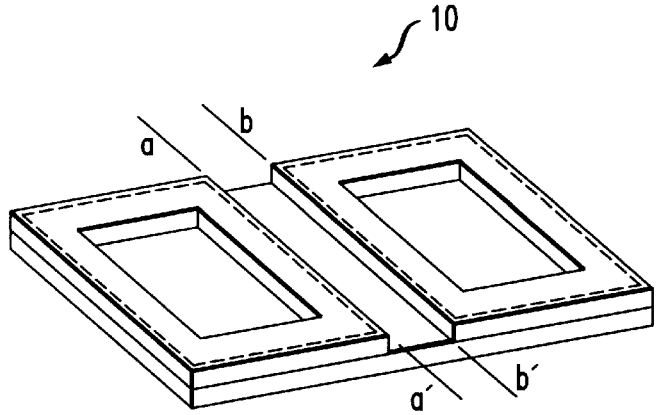
FIG. 4 shows a perspective view of the embodiment shown in FIG. 3 with its various constituent parts brought together.

Transparent portions 30 and 30' may be fabricated of a clear polyvinyl polymeric material, or any of a number of other suitable plastics which are within the knowledge of the skilled artisan. The general requirements are that these material(s) protect the underlying photograph, and yet be clear enough so as to allow visual acuity FIG. 4 shows a perspective view of the embodiment shown in FIG. 3 with its various constituent parts brought together.

Figure 5:
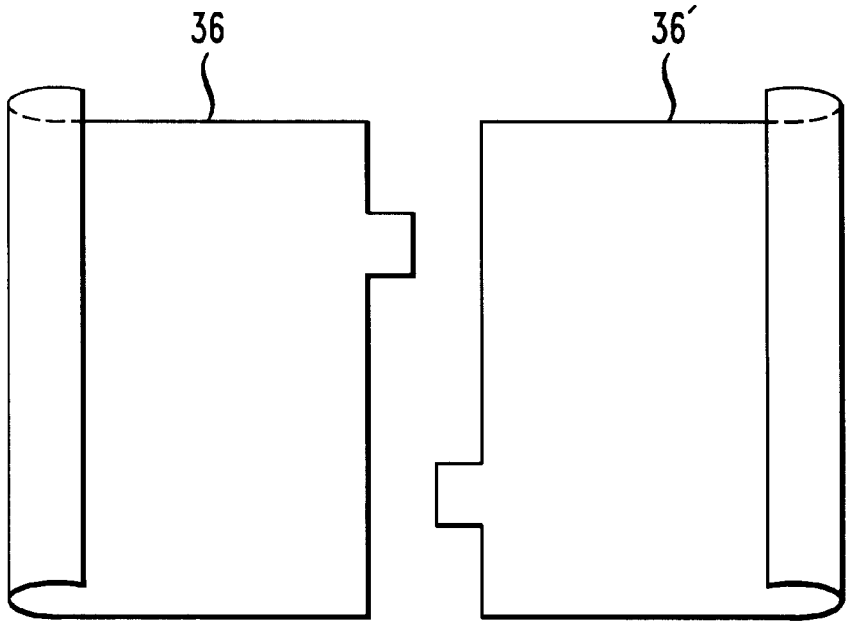
FIG. 5 is a front elevational view of a pair of specialized picture holders constructed in accordance with the present invention.
Figure 6:
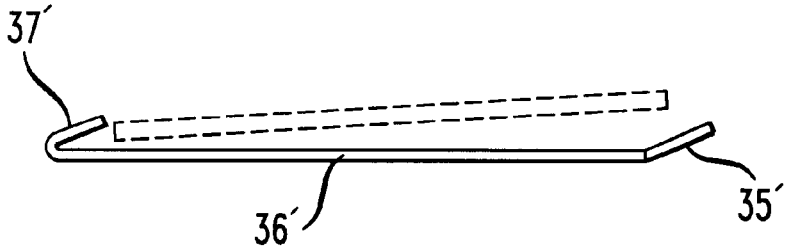
FIG. 6 is an end view demonstrating the use of one of the specialized picture holders shown in FIG. 5. An end view of a photograph is also shown in phantom lines.
Figure 7:
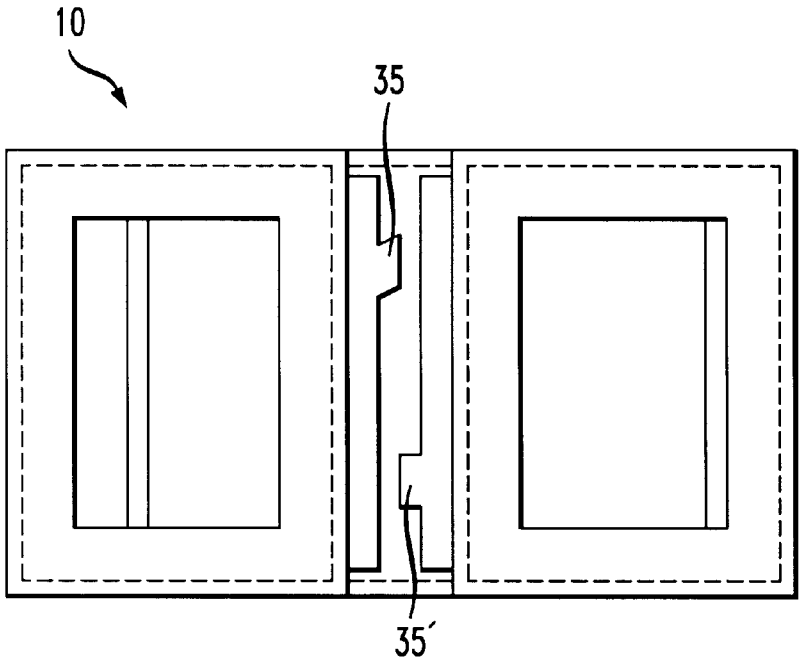
FIG. 7 is a front elevational view of the invention depicted in conjunction with the specialized picture holders shown in FIGS. 5 and 6.

As in FIG. 3, slits for the insertion of photographs are provided along edges a—a and b—b. FIG. 5 is a front elevational view of a pair of specialized picture holders 36 and 36'. A picture holder 36 facilitates the insertion and removal of a photograph within and without a fully assembled wallet insert 10 such as shown in FIG. 7. FIG. 6 is an end view demonstrating the use of one of picture holder 36'. A photograph, shown in phantom lines, is placed on the flat surface of holder 36' so that the photo engages clip 37'. Handle 35' provides a reinforced guide with which a user can insert holder 36, and an accompanying photo, with ease into wallet insert 10 as depicted in FIG. 7.

Picture holders 36 and 36' can, but need not, be made of the same materials as transparent portions 30 and 30', namely clear polyvinyl polymerics. As for the transparent portions 30 and 30, the general requirements are that the substrates for picture holders 36 and 36' protect the underlying photographs, yet are clear enough to allow visual acuity. If these requirements are met, a picture holder can be used in lieu of the transparent portion described above in FIG. 1.

Figure 8:
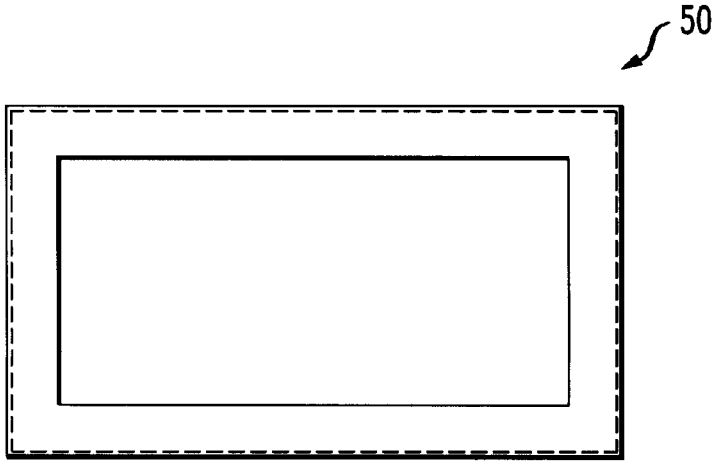
FIG. 8 shows a front elevational view of the second embodiment of the present invention.
Figure 9:
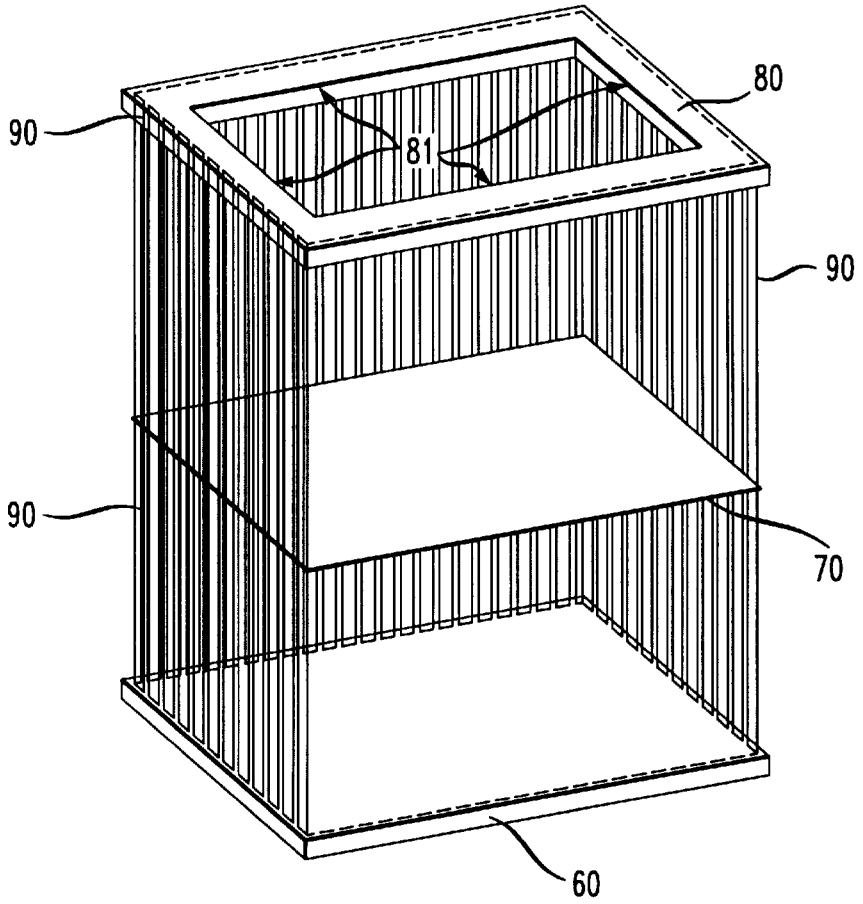
FIG. 9 shows an exploded view of the second embodiment shown in FIG. 8, demonstrating its various constituent parts.

FIG. 8 shows a front elevational view of a second embodiment of the present invention, in the form of wallet enclosure 50. FIG. 9 shows an exploded view of the second embodiment shown in FIG. 8, demonstrating its various constituent parts which are as follows: the second embodiment 50 includes back portion 60, a transparent member 70, and a frame 80. Back portion 60 and frame 80 can be made of leather or a leather-like material, but one skilled in the art can substitute any material which is suitable for such pieces, such as plastic, vinyl, suede, etc. Frame 80 has an edge 81 which defines an aperture to enable the viewing of any photographs placed between transparent member 70 and back portion 60.

FIG. 9 also shows stitching materials 90 for three sides of wallet enclosure 50. Stitching in a conventional manner can be used to hold the leather pieces together, but one skilled in the art can readily substitute other materials or techniques, such as adhesives for plastic substrates, to achieve the same function and purpose. Transparent member 70 can be made of a clear polyvinyl polymeric material as defined above for transparent portions 30 and 30'.

Figure 10:
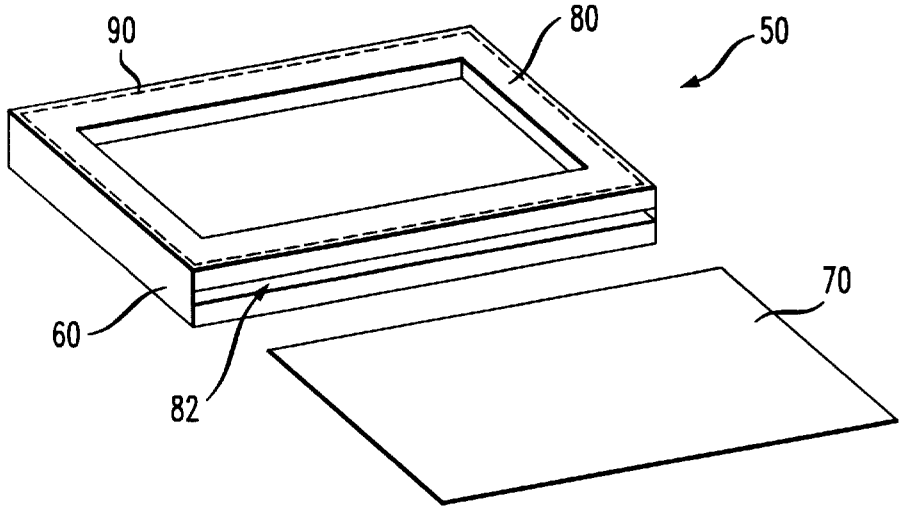
FIG. 10 shows a perspective view of the embodiment shown in FIGS. 8 and 9.

FIG. 10 shows a perspective view of the embodiment shown in FIG. 9 with frame 80 brought together with back portion 60. Transparent member 70 is shown outside wallet enclosure 50. The use of stitching materials 90 for three sides of wallet enclosure 50 provides an envelope-like structure with an opening 82 through which transparent member 70 is inserted into wallet enclosure 50. (This envelope-like structure is also present in FIG. 9). Opening 82 is also used to place photographs (not shown) securely under transparent member 70.

The above-described arrangement is merely illustrative of the principles of the present invention. Numerous modifications and adaptations thereof will be readily apparent to those skilled in the art without departing from the spirit and scope of the present invention.

What is claimed is:

1. A removable wallet insert for storing and protecting one or more photographs, and for inserting into a credit card slot of a wallet, the insert comprising:

a. a transparent portion;

b. a non-transparent portion; and c. a slideable member to facilitate insertion and/or removal of a photograph;

wherein the transparent portion and the non-transparent portion are configured so as to provide a substantially credit-card-sized, envelope-like structure for encasing the one or more photographs, and adapted for insertion into the credit card slot of the wallet, the envelope-like structure at least partially encasing the slideable member, the substantially credit-card-sized envelope-like structure having one or more slits for insertion of the one or more photographs therein, the transparent portion being positioned so as to permit viewing of at least a portion of the photograph when the photograph is substantially encased by the envelope-like structure.

2. A removable photograph holding insert for wallets and adapted for insertion into a credit card slot of a wallet, the insert comprising:

a. a back piece having at least one surface and at least one edge;

b. a transparent portion having a plurality of edges;

c. a frame; and d. a slideable member to facilitate insertion and/or removal of a photograph;

wherein all but at least one of the plurality of edges of the transparent portion is affixed between the back piece and the frame; at least one surface or edge of the back piece and at least one surface or edge of the transparent portion forming a slit for insertion of a photograph therein; wherein the back piece is substantially credit card sized; and wherein the back piece and the transparent portion at least partially encase the slideable member; the slidable member being adapted so as to facilitate at least one of insertion and removal of a photograph from the slit; the frame forming an opening so as to permit the viewing of a photograph inserted into the slit.

3. A removable photograph holding insert for wallets and adapted for insertion into a credit card slot of a wallet, the insert comprising:

a. a substantially credit card sized back piece;

b. a first transparent portion and a second transparent portion;

c. a first frame and a second frame, said first frame having a first central edge and said second frame having a second central edge, wherein said first transparent portion is held between said back piece and said first frame, and said second transparent portion is held between said back piece and said second frame when said back piece is affixed to said first and second frames, such that at least a portion of said first and second transparent portions are not visually obstructed by said first and second frames; said first transparent portion and said back piece forming a first slit for insertion of one or more photographs therein; said second transparent portion and said back piece forming a second slit for insertion of one or more photographs therein; and d. one or more slideable members to facilitate insertion and/or removal of a photograph, wherein the back piece and at least one of the first transparent portion and the second transparent portion at least partially encase the one or more slideable members; the slidable members being adapted so as to facilitate at least one of insertion and removal of a photograph from the slit.

4. The insert of claim 3 wherein said back piece and said frames are made from one or more materials selected from the group consisting of leather, plastics, fabrics, and canvas.

5. The insert of claim 3 wherein said transparent portions are made of a clear polyvinyl polymeric material.

6. The insert of claim 3 wherein said back piece is affixed to said first and second frames with a material selected from the group consisting of stitching, laminates, and adhesives.

7. The insert of claim 3 wherein said one or more slideable members are each photograph holders, each photograph holder comprised of a flat surface having a first end and a second end, wherein said first end has a photograph-engaging clip and said second end is provided with a handle means for inserting and withdrawing said photograph holder into and from said insert.

8. The insert of claim 7 wherein said back piece is affixed to said frame with a material selected from the group consisting of stitching, laminates and adhesives.

9. A photograph holding insert for wallets, comprising:

a. a substantially credit card sized back piece, b. a transparent member, c. a frame having a central edge, wherein said transparent member is held between said back piece and said frame when said back piece is affixed to said frame such that said transparent member is visible through said central edge, and d. a slideable photograph holding member, at least a portion of which is held between the transparent member and the back piece, wherein said insert is adapted for insertion into a credit card slot of a wallet.

10. The insert of claim 9 wherein said back piece and said frame are made from a material selected from the group consisting of leather, plastics, fabrics and canvas.

11. The insert of claim 9 wherein said transparent portion is made of a clear polyvinyl polymeric material.

* * * * *